United States Patent [19]

Crosslen

[11] Patent Number: 4,682,825

[45] Date of Patent: Jul. 28, 1987

[54] SECURITY DEVICE FOR POINT-OF-SALE DISPLAY RACK AND PRIMARILY STORE SHELVING

[75] Inventor: Louis J. Crosslen, Saukville, Wis.

[73] Assignee: Frank Mayer & Associates, Grafton, Wis.

[21] Appl. No.: 831,817

[22] Filed: Feb. 24, 1986

[51] Int. Cl.[4] ..... A47F 3/024

[52] U.S. Cl. ..... 312/42; 40/16.2; 211/59.2; 221/303; 312/234.4; 312/325

[58] Field of Search ..... 312/35, 42, 234.4, 291, 312/325, 328, 329; 211/59.2, 134, 169, 153; 40/16, 16.2, 16.4, 16.6, 17, 18, 19, 19.5; 221/303, 281

[56] References Cited

U.S. PATENT DOCUMENTS

| | | | |
|---|---|---|---|
| 1,407,309 | 2/1922 | Victorsohn | 312/325 X |
| 1,435,935 | 11/1922 | Malacos . | |
| 1,519,825 | 12/1924 | Douglass | 312/42 |
| 1,616,693 | 2/1927 | Havighorst | 211/59.2 X |
| 1,672,418 | 6/1928 | Lehman | 312/329 |
| 1,913,231 | 6/1933 | Carlstedt et al. . | |
| 1,940,254 | 12/1933 | Hopp et al. | 40/16.6 |
| 2,342,452 | 2/1944 | Casteen . | |
| 2,818,319 | 12/1957 | Bray | 312/42 |
| 3,320,690 | 5/1967 | Forsburg | 40/16.6 X |
| 3,464,748 | 9/1969 | Greogry . | |
| 3,512,652 | 5/1970 | Armstrong | 211/134 |
| 3,993,372 | 11/1976 | Mihos . | |
| 4,007,853 | 2/1977 | Bahneman | 312/42 X |
| 4,130,326 | 12/1978 | Hornblad . | |
| 4,305,628 | 12/1981 | Glasner . | |
| 4,396,237 | 8/1983 | Henry . | |
| 4,500,147 | 2/1985 | Reister | 312/291 |
| 4,597,614 | 7/1986 | Alexander | 312/42 |

FOREIGN PATENT DOCUMENTS

| | | | |
|---|---|---|---|
| 681811 | 2/1965 | Italy | 211/153 |

*Primary Examiner*—Kenneth J. Dorner
*Assistant Examiner*—Thomas A. Rendos
*Attorney, Agent, or Firm*—James E. Nilles; Nicholas A. Kees

[57] ABSTRACT

The security device of this invention comprises a transparent panel normally locked edgewise upright in the plane of front edges of a pair of vertically spaced shelves of a selfservice rack, blocking forward removal of all but the lowermost one or a predetermined few of a stack of like articles on the lower one of those shelves. At its top edge the panel has a link connection with the front edge of the upper of those shelves. Its lower edge portion is received in an upwardly opening groove in a fixed bracket, and the bottom of that groove so supports the panel that the link connection cooperates with resilience of the panel and bracket to provide a snap toggle action between locked and unlocked or releasing conditions. From the releasing condition the panel can be raised edgewise out of the groove and swung up to an inverted position and hooked there, permitting free access to the space between the shelves.

11 Claims, 6 Drawing Figures

SECURITY DEVICE FOR POINT-OF-SALE DISPLAY RACK AND PRIMARILY STORE SHELVING

FIELD OF THE INVENTION

This invention relates to point of sale merchandise display racks generally comprising existing vertically spaced store shelves, each of which supports a stack or stacks of substantially identical articles that are accessible substantially only from in front of front edges of the shelves to be withdrawn forwardly from them; and the invention is more specifically concerned with a security device comprising a panel which normally occupies an upright position at the front of such shelves, blocking access to all but the lowermost article or articles on each of the shelves, but which can be quickly and easily manipulated to a restocking position that allows free access to each shelf and the space above it.

BACKGROUND OF THE INVENTION

In self-service retail establishments, cartons of cigarettes and similar articles are usually exposed for sale on racks consisting of vertically spaced shelves on which the articles are arranged in stacks. Although the merchandise in such a rack is accessible substantially only from in front of the front edges of its shelves, the racks heretofore used for such displays have permitted free access to the entire space above each shelf, so that a person who wished to do so could very quickly and easily remove a large number of articles from any of the shelves. By smuggling the removed articles out of the store, such a person could steal as much as several hundred dollars worth of merchandise with very little effort and without great risk of being detected.

It is a premise of the present invention that shoplifting losses can be minimized—even though they cannot be completely prevented—by an expedient that partially blocks access to display shelves to prevent quantity removal of articles from them but nevertheless permits removal of one article at a time by a legitimate shopper.

It is perhaps obvious that this can be accomplished by installing a transparent panel in front of each stocked shelf of such a rack, located to block access to all but one or a few of the articles on the shelf, as disclosed in Malacos, U.S. Pat. No. 1,435,935. However, it has not heretofore been obvious how this solution could be implemented without giving rise to other problems. If the panel is securely fixed in place on the rack, it prevents or impedes restocking of the shelves so that, considering the value of stock clerks' time, it may eventually cost more than it saves. If the panel is easily moved out of the way, or if the manipulations needed for moving it out of the way are readily apparent from inspection, then it has little value as a security device. Another important consideration is that the security device be inexpensive in itself and capable of quick and easy installation, so that the cost of installing it is in line with potential savings it achieves. Obviously such a security device should not detract from the appearance of the display and should not present any material inconvenience to legitimate shoppers who serve themselves from the rack it protects.

As examples of prior attempts to solve the problems addressed by the present invention, reference may be made to U.S. Pat. Nos. 1,913,231, 3,464,748 and 4,130,326. U.S. Pat. Nos. 4,007,853 and 4,305,628 are typical of prior art unit-dispensing display cabinets that can be stocked through a lockable door at the rear of the cabinet. Such an arrangement is clearly unsuitable for a cabinet or rack that stands against a wall or stands back-to-back with another cabinet or display rack.

SUMMARY OF THE INVENTION

The general object of the present invention is to provide a security device for a conventional display rack comprising vertically spaced shelves that support stacked substantially identical articles, said security device being in the nature of a transparent plate or panel which is normally maintained in an upright blocking position at the front of one of the shelves wherein it permits removal from the shelf of only the lowermost article in each stack thereon, said plate or panel being instantly releasable with the use of any conventional elongated tool such as a screwdriver so that it can be swung up to and readily releasably locked in a restocking position wherein it permits free access to the entire space above the shelf, and being instantly returnable to its blocking position without the need for using any tool.

Another and more specific object of the invention is to provide a security device comprising a transparent panel that has a toggle connection with an upper one of two vertically spaced shelves of a display rack of the character described, said toggle connection being so arranged that it tends to maintain the panel either in its above described normal blocking position or in a releasing position from which the panel can be slightly lifted and swung forwardly and upwardly to its above described restocking position, the toggle connection being further so arranged that movement of the panel from its blocking position to its releasing position takes place with a relatively noisy snap action that discourages unauthorized manipulation, while movement from the releasing position to the blocking position, although also occurring with a snap action, requires no tool.

It is also a specific object of the invention to provide a security device of the character described that can be quickly and easily installed on vertically spaced shelves of an existing display rack without the need for boring any holes in the rack or employing any tools other than a screwdriver and which is attractive in appearance, leaves the contents of the rack completely visible, and provides means for convenient mounting of cards or labels bearing price and similar information.

Another specific object of the invention is to provide a security device of the character described which can be quickly and easily manipulated out of its blocking position by a person who knows how to do so, but which is so arranged that a person unfamiliar with it cannot readily discover how that operation is performed.

It is also an object of the invention to provide a sturdy and attractive security device of the character described that comprises relatively few and inexpensive parts.

These and other objects of the present invention that will appear as the description proceeds are achieved with the security device of the present invention, which is intended for cooperation with a display rack or the like that comprises a pair of vertically spaced shelves which have parallel lengthwise extending front edges and a lower one of which normally supports stacked substantially identical articles that are accessible substantially only from in front of said front edges. The security device, which prevents removal of more than a lowermost one of said articles at a time, is characterized by a flat transparent panel member having opposite substantially parallel top and bottom edges and opposite end edges, its length between its end edges being substantially equal to the length of said shelves and its height between its top and bottom edges being equal to slightly less than the distance between said shelves minus the height of one of said articles. The security device further comprises rigid link means having upper and lower ends; first connection means for so connecting the upper end of said link means with the upper one of said shelves as to provide for swinging of the link means about a link axis which is near and parallel to the front edge of that shelf; and second connection means connecting the lower end of the link means with the panel member for flatwise swinging of the panel member relative to the link means about a panel axis which is near and parallel to the top edge of the panel member and is spaced from and parallel to said link axis. A bracket member securable to the lower one of said shelves has an upwardly opening groove wherein a lower portion of the panel member is receivable to confine the panel member against swinging about said axes, the bottom of said groove being at an elevation for so supporting the panel member that the panel axis is in horizontally offset relation to the link axis. At least one of said members is sufficiently resilient to permit the link means to be swung about the link axis against yielding bias between a locking position in which the panel axis is rearwardly offset from the link axis and a releasing position in which the panel axis is forwardly offset from the link axis and from which the link means can be swung upward about the link axis to disengage the panel member from said groove and thus free the panel member to be swung forward and upward about the panel axis for unrestricted access to the space between said shelves.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
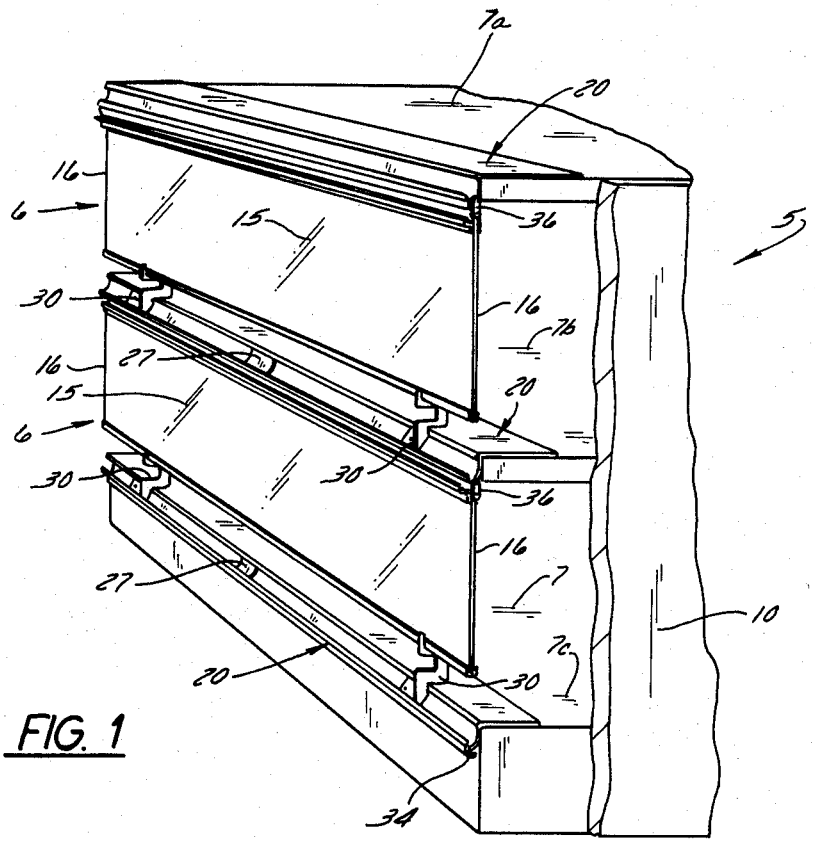
FIG. 1 is a front perspective view of a display rack upon which security devices of this invention have been installed.
Figure 3:
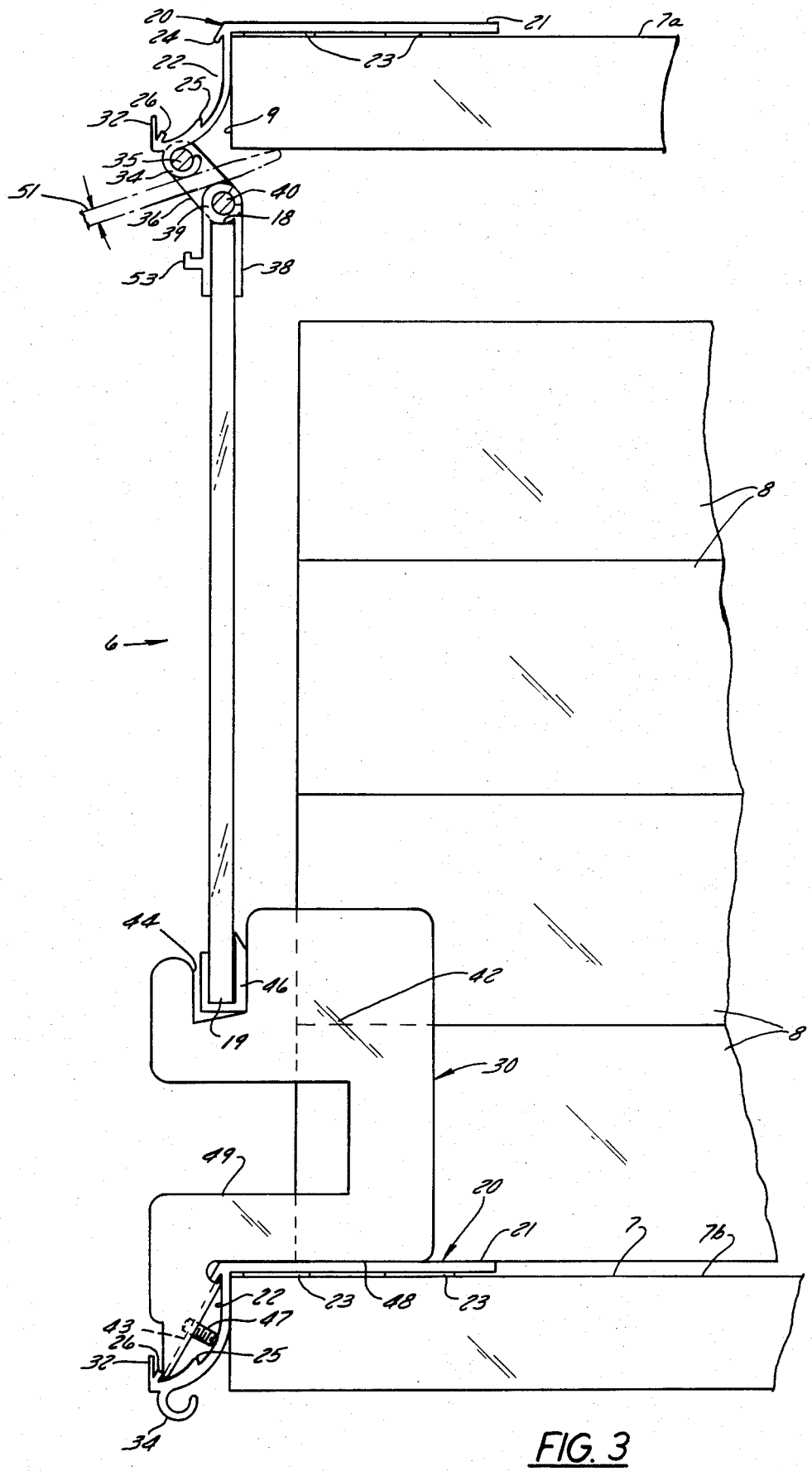
FIG. 3 is a view of the security device in end elevation, showing it in its locked or blocking condition.

Referring now to FIGS. 1 and 3, a rack or cabinet 5 for which the security device 6 of this invention is intended comprises two or more vertically spaced elongated shelves 7 which support stacked articles 8 and which have front edges 9 that are parallel and are contained in a single vertical plane. In this case the rack 5 is shown as having three shelves *7a, 7b, 7c,* but the top shelf *7a* is essentially only a cover which cooperates with opposite side walls 10 and a rear wall (not shown) to limit access to the spaces over the other shelves *7b, 7c* so that articles 8 on them are accessible substantially only from in front of the rack and must be withdrawn forwardly off of the shelves. The articles 8 on each shelf are substantially identical in size and shape and will typically be relatively small, readily stackable and of high value in relation to their size, as for example video casettes or cartons of cigarettes.

The security device 6 of this invention comprises a flat and plate-like cover or panel 15 for each shelf *7b, 7c* below the top one. As explained below, each panel 15 guards articles on its shelf and has a connection with the shelf immediately above the one it guards, being normally held in an edgewise upright position by the two shelves with which it is associated. The panels 15 are preferably transparent and made of a somewhat flexible plastic such as an acrylic resin. Each is preferably rectangular, having a length between opposite end edges 16 which is substantially equal to the length of the shelves and having a height, as measured between parallel top and bottom edges 18, 19, that is equal to slightly less than the vertical distance between the two shelves with which it is associated, minus the height of a predetermined number, most often one, of the stacked articles 8. In its normal upright blocking position (shown in FIG. 3) each panel 15 lies substantially in the vertical plane containing the front edges 9 of the shelves, with its top edge 18 close to the front edge of the upper one of the two shelves with which it is associated. In this position, owing to the height relationship just described, the bottom edge 19 of the panel is spaced above the shelf that it guards by a continuous gap a little larger than the height of a predetermined number of the articles 8 on that shelf; and therefore the panel permits removal from that shelf of only a predetermined number of articles at a time, specifically usually the lowermost article in each stack on the shelf, which must of course be drawn forwardly beneath the panel.

For supporting each panel 15 in its blocking position and in a restocking position described hereinafter, there is secured to the front portion of each of the two shelves with which the panel is associated an elongated shelf bracket or connector body 20 having a length equal to that of the panel and preferably having a cross-section that is uniform all along its length to be suitable for production as an extrusion. The connector body 20 on the uppermost shelf *7a* of the rack need not be identical with the connector bodies on the shelves beneath it, and similarly the connector body on the lowermost shelf *7c* can be somewhat different from the others; but for simplicity and economy all of the connector bodies are generally manufactured to be alike, as here shown.

Thus each connector body 20 has an elongated flat and strip-like attachment portion 21 that flatwise overlies and is secured to the upper front marginal surface of a shelf along substantially its whole length and has a supporting portion 22 which extends along the length of the attachment portion and projects laterally forwardly and downwardly from it. The attachment portion 21 is preferably secured to a shelf by means of lengthwise extending strips 23 of double-sided pressure sensitive tape at its underside, so that the connector bodies can be installed on the rack without the use of tools and without need for drilling holes or otherwise modifying or defacing the rack. When thus attached, supporting portion 22 extends downward and in front of shelf *7a*.

Preferably the supporting portion 22 of each connector body is of forwardly concave arcuate cross-section. On its front surface the supporting portion has a plurality of lengthwise extending laterally spaced ledges, there being in the preferred case three such ledges 24, 25, 26. One of these ledges, designated by 24, is at the top of the supporting portion, near its junction with the attachment portion, and projects laterally downwardly. An intermediate ledge 25, about midway between the top and bottom edges of the supporting portion, projects laterally upwardly to oppose the upper ledge 24. It will be apparent that the ledges 24 and 25 can cooperate to retain cards or tags 27 (FIGS. 1 and 2) which have opposite edges respectively engaged with them and which bear price or similar information. The third ledge 26, which is near the front edge of the supporting portion, projects obliquely rearwardly and upwardly and thus opposes the top ledge 24 and cooperates with it for retention of brackets 30 as explained hereinafter. Also extending all along the front edge of the supporting portion 22 is a straight upwardly projecting flange 32 that serves for releasably retaining the panel in a restocking position, as explained hereinafter.

At its underside, spaced a little to the rear of its front edge, at its lowest point, the supporting portion 22 has an integral pintle tube 34 of C-shaped cross-section that extends along its length. A pin means or pintle 35 is partway received with a drive fit in each end portion of the pintle tube 34 and projects beyond it through an upper end of a short, rigid link 36 that provides a toggle connection between the panel and the connector body 20. The links 36—one outwardly adjacent to each end of the connector body—are thus swingable about a common link axis which is defined by the coaxial pintles 35 and which is near and parallel to the front edge 9 of the upper one of the two shelves with which the panel is associated.

The panel, in turn, is swingably connected with the two links 36 by means of an upper edge guard 38 of substantially U-shaped cross-section, suitably made as an extrusion, that embraces and is secured to the top marginal edge portion of the panel along its entire length. On the exterior of its bight portion, extending along the length thereof, this edge guard has a pintle tube 39, preferably of C-shaped cross-section. Pins or pintles 40, each partway received with a drive fit in an end portion of the pintle tube 39 and projecting outwardly beyond it, extend through the lower portions of the respective links 36. The pintles 40, which are of course coaxial with one another, thus define a panel axis about which the panel 15 is flatwise swingable relative to the links 36 and which is parallel to the link axis defined by the pintles 35 as well as being parallel to and near the top edge 18 of the panel.

Figure 2:
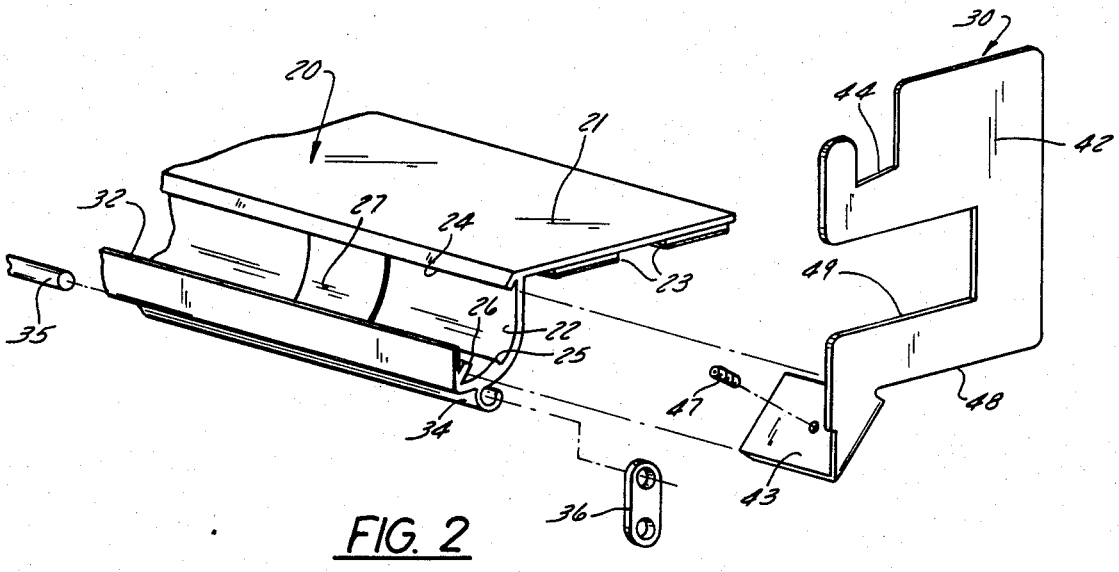
FIG. 2 is a fragmentary perspective view of portions of the structure whereby the panel of the security device is supported.
Figure 5:
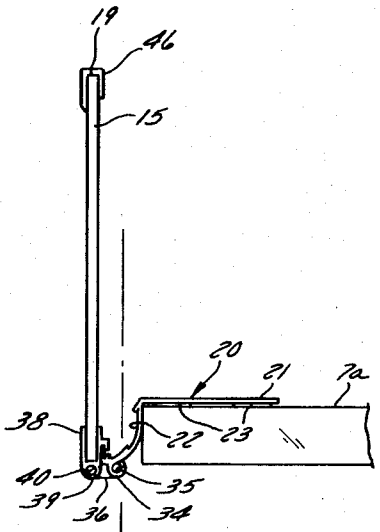
FIG. 5 is a view generally similar to FIG. 4 but showing the panel releasably held in its restocking position.
Figure 6:
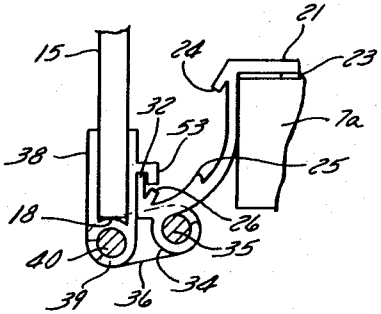
FIG. 6 is an enlarged fragmentary view in vertical section showing the releasable connection by which the panel is held in its restocking position.

When a panel 15 is in its normal blocking position (shown in FIG. 3) its lower portion is confined against flatwise swinging by means of the upstanding retaining brackets 30, which are secured to the connector body 20 on the lower one of the two shelves with which the panel is associated. Referring mainly to FIG. 2, each bracket 30 can be made of a single piece of sheet metal, with a flat body portion 42 and a flat tab portion 43 that is bent out of the plane of the body portion. With the bracket 30 in place, the surfaces of its body portion 42 extend vertically and fore-and-aft, so that it presents minimal interference to withdrawal of articles past it and under the panel. Each bracket 30 projects forwardly a short distance beyond the vertical plane (FIGS. 3, 4 and 5) that contains the front edges of the shelves, and it has an upwardly opening notch or groove 44 which is approximately centered on that plane and in which the lower marginal edge portion of the panel is receivable. Preferably the lower edge portion of the panel is embraced along its length by a U-section lower edge guard 46, which can be formed as an extrusion and which protects the panel against being scratched or abraded by the brackets.

The tab portion 43 of each bracket 30 has its surfaces perpendicular to those of the body portion 42 but obliquely forwardly and downwardly inclined relative to the straight bottom edge 48 of the body portion. Opposite straight and parallel top and bottom edges on this tab portion 43 are lengthwise slidably engaged under the upper ledge 24 and the bottom ledge 26, respectively, on the supporting portion 22 of the connector body. Each bracket 30 is thus adjustable as to its position along the length of the connector body 20 to which it is secured, but it can be releasably fixed in any such position of adjustment by means of a set screw 47 which is threaded through its tab portion 43 and engaged against the concave front surface of the supporting portion. With short shelves one bracket may be sufficient for each panel. With longer shelves two or more may be needed.

It is desirable that the bracket 30 be sufficiently resilient edgewise to be flexible downwardly to some extent. To that end it is made with a substantially large forwardly opening bay or cutout 49 in its body portion, to be substantially C-shaped as seen from either side, with vertically spaced forwardly projecting upper and lower arms and with the panel confining notch or groove 44 in the front portion of the upper arm. The cutout 49 also serves to facilitate forward withdrawal of articles past the bracket. The straight bottom edge 48 of the lower arm overlies the flat top surface of the attachment portion 21 of the connector body.

Figure 4:
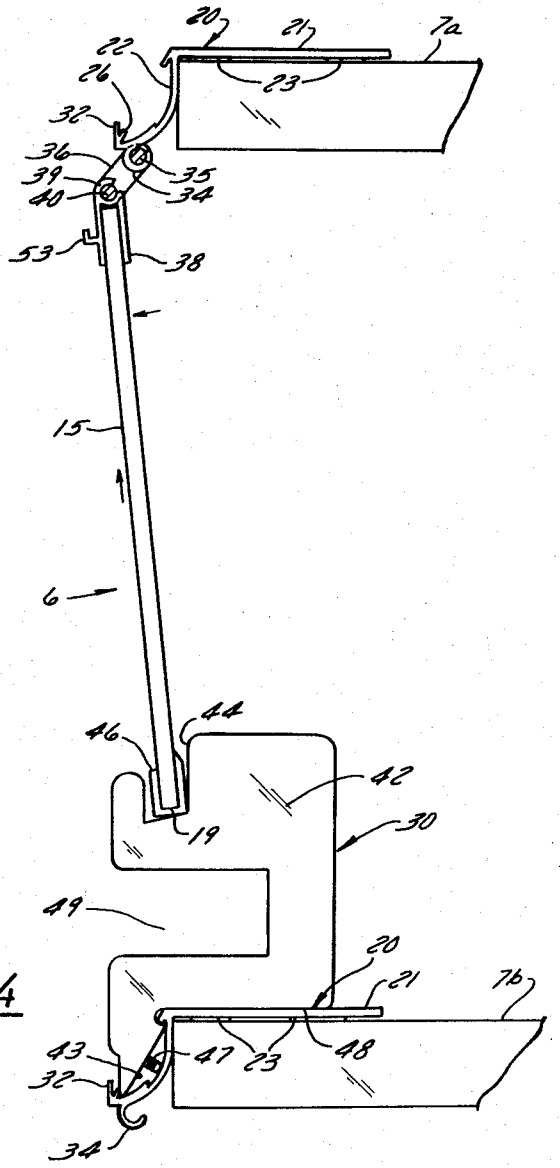
FIG. 4 is a view generally similar to FIG. 3, but on a smaller scale and showing the releasing condition.

With the bracket 30 installed, the bottom of its panel confining groove 44 is at such an elevation that the panel, when received in it, supports the links 36 at an offset or inclination to the vertical, disposing the panel axis defined by the pintles 40 in horizontally offset relation to the link axis defined by the pintles 35. Thus, the panel axis tends to be either behind the link axis, with the link 36 offset toward the shelves 7, in a locked position, as shown in FIG. 3, or in front of the link axis, with the link 36 offset away from the shelves 7, in an unlocked position, as shown in FIG. 4. The combined resiliencies of the panel 15 and of the brackets 30 enable the links 36 to be swung from either of these positions to the other with a snapping toggle action. Although the links can be readily snapped to their rearwardly inclined positions shown in FIG. 3 by pushing rearward on the top portion of the panel, there is nothing on the device that can be grasped for pulling the top of the panel forwardly. Therefore the links 36 must be swung forward, to the unlocked position shown in FIG. 4, with the use of a screwdriver 51 or similar long, slender tool that is inserted between the adjacent pintle tubes 34, 39 and swung upward as a lever.

Once the links 36 and the top edge 18 of the panel have been thus brought to the unlocked or releasing position shown in FIG. 4, the panel 15 can be raised edgewise to disengage its bottom portion from the groove 44 in the brackets, such upward movement of the panel being accommodated by forward and upward swinging of the links 36 about the link axis. With the panel disengaged from the brackets it can be swung upward about the link and panel axes to the inverted restocking position shown in FIG. 5, in which its bottom edge 19 is uppermost and it projects vertically upward from the front edge of the upper one of the two shelves with which it is associated, leaving the entire space between those shelves freely accessible from in front of them. For releasably securing the panel in this restocking position, the U-shaped upper edge guard 38 is formed with a hooking flange 53 that engages over the upright flange 32 on the front of the supporting portion 22 of the connector body. Relative to the normal locked or blocking position (FIG. 3) of the panel, the hooking flange 53, which preferably extends along the full length of the edge guard 38, projects laterally forwardly and upwardly from the front leg of that edge guard.

When the shelf guarded by the panel has been restocked, the panel is unhooked from the upright flange 32 and, with its lower edge portion guided into the groove 44 in the bracket 30, it is swung back down to the releasing position shown in FIG. 4, whereupon it can be pushed back to its locked or blocking position (FIG. 3) without use of a tool.

Although an unauthorized person can dislodge the panel from its blocking position with the use of a key or the like, he is not likely to learn how to do this from mere casual inspection of the device. Furthermore, snapping the panel between its blocking and releasing positions tends to be noisy because the panel acts as a sounding board, and such noise discourages tampering because it attracts attention.

From the foregoing explanation taken with the accompanying drawings, it will be apparent that this invention provides a simple and inexpensive security device, capable of being quickly and easily installed on a point-of-sale display rack that comprises vertically spaced shelves and whereby the space between a pair of those shelves is partially blocked to prevent withdrawal, from a lower shelf of the pair, of more than one at a time of articles stacked on it. It will also be apparent that the security device of this invention leaves merchandise on the shelves completely visible, does not offer any material interference to one-at-a-time removal of articles from the shelves by legitimate shoppers, and causes no significant delay or inconvenience in restocking of the protected shelves.

What is claimed as the invention is:

1. Security means cooperable with a pair of vertically spaced shelves which have parallel lengthwise extending front edges and a lower one of which normally supports stacked substantially identical articles that are accessible substantially only from in front of said front edges, for preventing removal of more than a lowermost predetermined number of those articles at a time, said security means comprising:

A. a flat panel member having opposite substantially parallel top and bottom edges and opposite end edges and having
   (1) a length between its end edges that is substantially equal to the length of said shelves and
   (2) a height between its top and bottom edges that is equal to slightly less than the distance between said shelves minus the height of said predetermined number of said articles;

B. link means having upper and lower ends;

C. first connection means for so connecting the upper end of said link means with the upper one of said shelves as to provide for swinging of the link means about a link axis which is near and parallel to the front edge of that shelf;

D. second connection means connecting the lower end of the link means with the panel member for flatwise swinging of the panel member relative to the link means about a panel axis which is near and parallel to the top edge of the panel member and is spaced from and parallel to said link axis;

E. a bracket member securable to the lower one of said shelves and having an upwardly opening groove wherein a lower portion of the panel member is receivable to confine the panel member against swinging about said axes, the bottom of said groove being at an elevation for so supporting the panel member that the panel axis is in horizontally offset relation to the link axis; and F. at least one of said members being sufficiently resilient to permit the link means to be swung about the link axis against yielding bias between a locked position in which the panel axis is rearwardly offset from the link axis and a releasing position in which the panel axis is forwardly offset from the link axis and from which the link means can be swung upward about the link axis to disengage the panel member from said groove and thus free the panel member to be swung forward and upward about the panel axis for unrestricted access to the space between said shelves.

2. The security means of claim 1 wherein said link means comprises a pair of substantially identical links, one near each of said end edges of the panel, further characterized by said first connection means comprising:

(1) a first connector body having an elongated flat and strip-like attachment portion for flatwise overlying securement to the upper surface of said upper shelf along the front edge thereof, (2) a pair of pintles, one for each of said links, each having an outer end portion received in an upper portion of its link to pivot the link for swinging about said link axis, and (3) means fixed to said attachment portion defining a pair of pintle holders, one near each end of said attachment portion, in each of which another portion of one of said pintles is confined, said pintle holders being in downwardly and forwardly spaced relation to said attachment portion and disposing said pintles in coaxial relation to one another to define said link axis.

3. The security means of claim 2, further characterized by:

(1) said first connector body further having an elongated supporting portion formed in one piece with said attachment portion, extending lengthwise along said attachment portion and projecting laterally obliquely downwardly and forwardly therefrom, (2) said pintle holders comprising the end portions of a tube which extends lengthwise along said supporting portion, at the underside of the supporting portion and near a front edge thereof, and (3) said first connector body being of uniform cross-section all along its length.

4. The security means of claim 3, further characterized in that:

said supporting portion is of arcuate forwardly and upwardly concave cross-section and has on its front surface, extending along its length, a pair of laterally spaced and opposing ledges which can cooperate to hold a card that displays price or similar information.

5. The security means of claim 4, further characterized by:

a second connector body, identical to said first connector body, secured to said lower shelf;

said bracket member being formed in one piece from sheet metal and comprising (1) a substantially C-shaped body portion that has forwardly projecting, vertically spaced apart upper and lower arms, said groove being in the front portion of said upper arm, and (2) a substantially flat tab portion projecting from said lower arm and bent out of the plane of said body portion, said tab portion having opposite substantially parallel edges that are engageable with said ledges to secure said bracket to said supporting portion of said second connector body for lengthwise sliding adjustment therealong.

6. The security means of claim 3, further characterized by:

(1) said supporting portion of said first connector body having a laterally upwardly projecting flange extending along the front edge thereof;

(2) an elongated upper edge guard of substantially U-shaped cross-section embracing and secured to the upper margin of said panel along the length thereof, said edge guard having thereon a forwardly and upwardly projecting hooking flange which is releasably engageable with said flange on the supporting member for holding the panel in an edgewise upright restocking position in which its bottom edge is uppermost.

7. A theft-deterring device for deterring removal of more than a predetermined number of articles from conventional racks of store shelves, said device to be attached to at least two of said shelves, an upper shelf and a lower shelf, and comprising:

a first shelf bracket attached to said upper shelf, extending downward in front of said shelf, and having a tube at the lowest point thereof;

a first pair of pins, each inserted into an opposite end of said tube, and extending a short distance out each end thereof;

a pair of toggle links, one end of each link being pivotably attached to each of said first pair of pins;

a transparent panel member sized so as to cover the entire space between said upper and lower shelves except for a continuous gap between said panel member and said lower shelf large enough to allow removal of a predetermined number of items therebetween, said panel member pivotably attached to the opposite ends of said toggle links so as to be swingable open to allow access to all of said articles;

a second shelf bracket, identical to said first shelf bracket, attached to said lower shelf and extending downward in front of said lower shelf; and at least one upstanding retaining bracket attached to said second shelf bracket, having a notch in the upper edge thereof sized to accommodate a bottom edge of said panel member, the bottom of said notch being located at an elevation above said lower shelf to allow engagement with said bottom edge of said panel member and to require some flexing in the bracket and panel member in order to move said toggle link from an unlocked position, wherein it is offset away from said shelves, to a locked position, wherein it is offset toward said shelves.

8. A theft dterring device as recited in claim 7 futher comprising means on said panel member and said first shelf bracket for releasably locking said panel member open.

9. A theft deterring device as recited in claim 8 wherein said locking means includes:

a laterally upwardly projecting flange extending along the lower front edge of said first shelf bracket;

a forwardly and upwardly projecting hooking flange attached to the upper edge of said panel member, which flange is releasably engageable with said flange on said first shelf bracket for holding the panel member in an edgewise upright restocking position in which its bottom edge is uppermost.

10. Security means cooperable with a pair of vertically spaced shelves which have parallel lengthwise extending front edges and a lower one of which normally supports stacked substantially identical articles that are accessible substantially only from in front of said front edges, for preventing removal of more than a lowermost predetermined number of those articles at a time, said security means comprising:

A. a flat panel member having opposite substantially parallel top and bottom edges and opposite end edges and having (1) a length between its end edges that is substantially equal to the length of said shelves and (2) a height between its top and bottom edges that is equal to slightly less than the distance between said shelves minus the height of said predetermined number of said articles;

B. link means having upper and lower ends and comprising a pair of substantially identical links, one near each of said end edges of said panel;

C. first connection means for so connecting the upper end of said link means with the upper one of said shelves as to provide for swinging of the link means about a link axis which is near and parallel to the front edge of that shelf, comprising:

(1) a first connector hody having an elongated flat and strip-like attachment portion for flatwise overlying securement to the upper surface of said upper shelf along the front edge thereof, (2) a pair of pintles, one for each of said links, each having an outer end portion received in an upper portion of its link to pivot the link for swinging about said link axis, (3) means fixed to said attachment portion defining a pair of pintle holders, one near each end of said attachment portion, in each of which another portion of one of said pintles is confined, said pintle holders being in downwardly and forwardly spaced relation to said attachment portion and disposing said pintles in coaxial relation to one another to define said link axis;

(4) said first connector body being of uniform cross-section all along its length and having an elongated supporting portion formed in one piece with said attachment portion, extending lengthwise along said attachment portion and projecting laterally obliquely downwardly and forwardly therefrom, said supporting portion being of arcuate forwardly and upwardly concave cross-section and having on its front surface, extending along its length, a pair of laterally spaced and opposing ledges which can cooperate to hold a card that displays price or similar information;

(5) said pintle holders comprising the end portions of a tube which extends lengthwise along said supporting portion, at the underside of the supporting portion and near a front edge thereof;

D. second connection means connecting the lower end of the link means with the panel member for flatwise swinging of the panel member relative to the link means about a panel axis which is near and parallel to the top edge of the panel member and is spaced from and parallel to said link axis;

E. A second connector body, identical to said first connector body, secured to said lower shelf;

F. A bracket member securable to the lower one of said shelves and having an upwardly opening groove wherein a lower portion of the panel member is receivable to confine the panel member against swingling about said axes, the bottom of said groove being at an elevation for so supporting the panel member that the panel axis is in horizontally offset relation to the link axis, said bracket member being formed in one piece from sheet metal and comprising:

(1) a substantially C-shaped body portion that has forwardly projecting, vertically spaced apart upper and lower arms, said groove being in the front portion of said upper arm, and (2) a substantially flat tab portion projecting from said lower arm and bent out of the plane of said body portion, said tab portion having opposite substantially parallel edges that are engageable with said ledges to secure said bracket to said supporting portion of said second connector body for lengthwise sliding adjustment therealong; and G. at least one of said members being sufficiently resilient to permit the link means to be swung about the link axis against yielding bias between a locked position in which the panel axis is rearwardly offset from the link axis and a releasing position in which the panel axis is forwardly offset from the link axis and from which the link means can be swung upward about the link axis to disengage the panel member from said groove and thus free the panel member to be swung forward and upward about the panel axis for unrestricted access to the spaced between said shelves.

11. The security means of claim 10, further characterized by:

(1) said supporting portion of said first connector body having a laterally upwardly projecting flange extending along the front edge thereof;

(2) an elongated upper edge guard of substantially U-shaped cross-section embracing and secured to the upper margin of said panel along the length thereof, said edge guard having thereon a forwardly and upwardly projecting hooking flange which is releasably engageable with said flange on the supporting member for holding the panel in an edgewise upright restocking position in which its bottom edge is uppermost.

* * * * *